US006481708B2

(12) United States Patent
Rebeaud

(10) Patent No.: US 6,481,708 B2
(45) Date of Patent: Nov. 19, 2002

(54) DELIVERY STATION FOR A CONVERTING PRESS

(75) Inventor: Jean-Claude Rebeaud, Le Mont (CH)

(73) Assignee: Bobst S.A. (CH)

( * ) Notice: Subject to any disclaimer, the term of this patent is extended or adjusted under 35 U.S.C. 154(b) by 0 days.

(21) Appl. No.: 09/855,427

(22) Filed: May 15, 2001

(65) Prior Publication Data

US 2001/0042955 A1 Nov. 22, 2001

(30) Foreign Application Priority Data

May 16, 2000 (CH) ..... 0961/00

(51) Int. Cl.[7] ..... B65H 31/12

(52) U.S. Cl. ..... 271/218; 281/213; 414/790.8; 414/793.4

(58) Field of Search ..... 271/213, 218, 271/158, 159; 414/789.5, 790.8, 793.4

(56) References Cited

U.S. PATENT DOCUMENTS

RE25,018 E * 8/1961 Howdle et al. ..... 414/790.8
4,043,459 A * 8/1977 Moreau ..... 414/789.5
5,135,351 A * 8/1992 Rathert ..... 414/789.5
5,529,456 A * 6/1996 Luxem et al. ..... 271/158
5,664,767 A * 9/1997 Voss ..... 271/218
5,669,755 A * 9/1997 Zahn ..... 414/789.5
6,135,445 A * 10/2000 Gamperling et al. ..... 414/790.8
6,149,149 A * 11/2000 Gammerler et al. ..... 271/218
6,286,826 B1 * 9/2001 Hummel et al. ..... 271/159

FOREIGN PATENT DOCUMENTS

DE 27252267 * 11/1978 ..... 271/218

* cited by examiner

*Primary Examiner*—H. Grant Skaggs
(74) *Attorney, Agent, or Firm*—Ostrolenk, Faber, Gerb & Soffen, LLP

(57) ABSTRACT

A delivery station for a converting press for paper or cardboard sheets having a transverse roller located downstream from the delivery area of a blanking station, and a movable carriage downstream from the roller. The carriage receives a plurality of bars that form a non-stop delivery rack. The carriage is guided for motion in the longitudinal direction by a transporting device. The transporting device, the transverse roller and the carriage are mounted on a vertically movable frame suspended on opposite sides by chains ran by a power source through a transmission shaft. The vertical run of the delivery rack is adjustable between a high position and a low position, the low position being determined by the length of the lower blanking tool joggers of the blanking station.

9 Claims, 3 Drawing Sheets

DELIVERY STATION FOR A CONVERTING PRESS

BACKGROUND OF THE INVENTION

1. Field of the Invention

The present invention relates to a delivery station of a converting press for paper or cardboard sheets including a transverse roller located downstream from the delivery area and a movable carriage downstream from the aforesaid roller, which is able to receive a plurality of bars so as to form a non-stop blanking delivery rack, the aforesaid carriage being guided in a longitudinal direction by a carrying device. The words "upstream","downstream","longitudinal" and "transverse" are used here with reference to the running direction of the sheets in the press.

2. Related Art

In delivery stations as previously defined, the blanking operation is performed at an upstream blanking station, and involves, after converting and complete waste stripping, breaking the nicks between the sheet blanks by means of an upper male tool and a lower female tool vertically assembled one above the other in the sheets delivery area. The upper tool is made of pushing devices slightly smaller than the circumference of the blanks. The lower tool is made of longitudinal and transverse bars forming a rack corresponding to the circumference of the blanks. The blanks fall through the spaces of this rack and pile up vertically in,the delivery area.

To form piles of separate and fixed blanks under these tools, on the delivery vane of the delivery station, a periodic insertion of a stabilization sheet is needed. So that this insertion can be carried out without stopping production, one uses a device called a non-stop delivery rack. This device includes a carriage movable in the longitudinal direction of the press. The carriage comprises two transverse beams on which bars can be laid out longitudinally to form a non-stop blank delivery rack. The bars are, generally rod-shaped. The head of each rod can fit into an opening of the carriage beam which is furthest away from the delivery station and can be secured to it by screwing. The end of the rod nearest the head rest, on the second transverse beam of the carriage. The opposite end of the rod rests on a transverse roller located just next to and downstream from the blanks delivery station. To carry on an insertion operation, the movable carriage moves the bars under the lower blanking tool and a pair of bars come to support each blank falling down. For large size blanks, a larger number of bars per blank can be used. The non-stop delivery rack receives from time to time the blanks piling up during the insertion operations. After each insertion operation, the bars forming the rack leave the delivery area, by a longitudinal movement of the movable carriage, crossing with vertical joggers of the lower blanking tool, so as to lay the blanks onto the insertion sheet.

A preselector determines the number of cuttings for each inserted package as well as the number of packages and/or the height of the piles. The whole device functions automatically and goes on according to a previously set operating time.

A disadvantage of this non-stop delivery rack device occurs in the fact that the height of the temporary storage on the bars engaged in the delivery area is only of about 35 mm. However, an insertion period is of approximately 20 to 30 seconds. The storage height is sufficient for cardboard sheets of low thickness or low basis weight and for relatively slow processing speeds. For the uptodate fastest production rates, as well as for relatively thick cardboard or waste board sheets, this storage height. becomes insufficient. If the thickness of a new thin cardboard sheet is of about 3/10 of millimeters, this thickness increases up to 5/10, even more, when it is driven back to carry out the folds of the board. With a production rate of 3 sheets per second, the available height of storage of 35 mm can be reached in approximately 20 seconds' time, even less. To increase the time available for insertion, is has been proposed to increase this storage height while lowering the level of the non-stop rack. But in this case, the precision of the laying out of the blanks is reduced, particularly in the case of small-size blanks. With a width lower than 10 cm and with a double waste height, the blanks fall crosswise and the piles are badly piled up.

BRIEF SUMMARY OF THE INVENTION

The aim of this invention is to increase the storage capacity on the nonstop delivery rack, while maintaining the height of the blanks waste at the lowest level so as to ensure a good piling up.

This aim is reached in a previously defined delivery station by the fact that the station comprises an elevating device that simultaneously moves the roller and the movable carriage downwards while the blanks are piling up on the delivery rack.

By use of the elevating device according to the invention, the delivery rack laid onto the movable carriage and on the roller moves downward while the blanks are piling up on this rack during the insertion operation. The insertion period is thus obviously increased. The height of the blanks waste thus becomes adjustable, and the height of the free waste can stay at lower-level, which is particularly advantageous for low blanks.

According to a procedure of the invention, the vertical displacement downwards is preset owing to the work carried out by the press, particularly according to the thickness of the board dealed with.

According to another procedure, the vertical displacement downwards is controlled by the detection of the upper sheet of the pile laying onto the delivery rack.

The carrying device of the movable carriage and the transverse roller can be rigidly secured in a vertically movable frame. The vertically movable frame can especially be a frame crossing the whole width of the station, suspended on its two sides by chains driven by only one motor through a transmission shaft.

The elevating device preferably includes correction means and means for the maintenance of the horizontality of the upper side of the bars forming the non-stop delivery rack. These correction means can include lateral racks and guidance rollers and/or torsion bars connecting distant parts of the vertically movable frame.

The vertical run of the non-stop delivery rack can be adjustable between a high position, where the waste height is preferably minimal, and a low position, this low position being determined by the length of the lower blanking tool joggers.

This low position can be preset: the length of the low blanking tool joggers is usually known and can thus be stored while programming the machine. Instead of including this parameter into the program, one can also detect the position of the rack compared to the joggers. To do so, the vertically movable frame can carry, upstream of the transverse roller, a feeler arm horizontally scanning the space located immediately below the free ends of the bars forming the delivery rack, so as to detect the height of the frame where the rack goes down below the lower end of the joggers.

BRIEF DESCRIPTION OF THE DRAWINGS

Other characteristics and advantages of the invention will be apparent to ones skilled in this technical field from the following description of a preferred embodiment, with reference to the drawing in which.

DETAILED DESCRIPTION OF THE INVENTION

Figure 1:
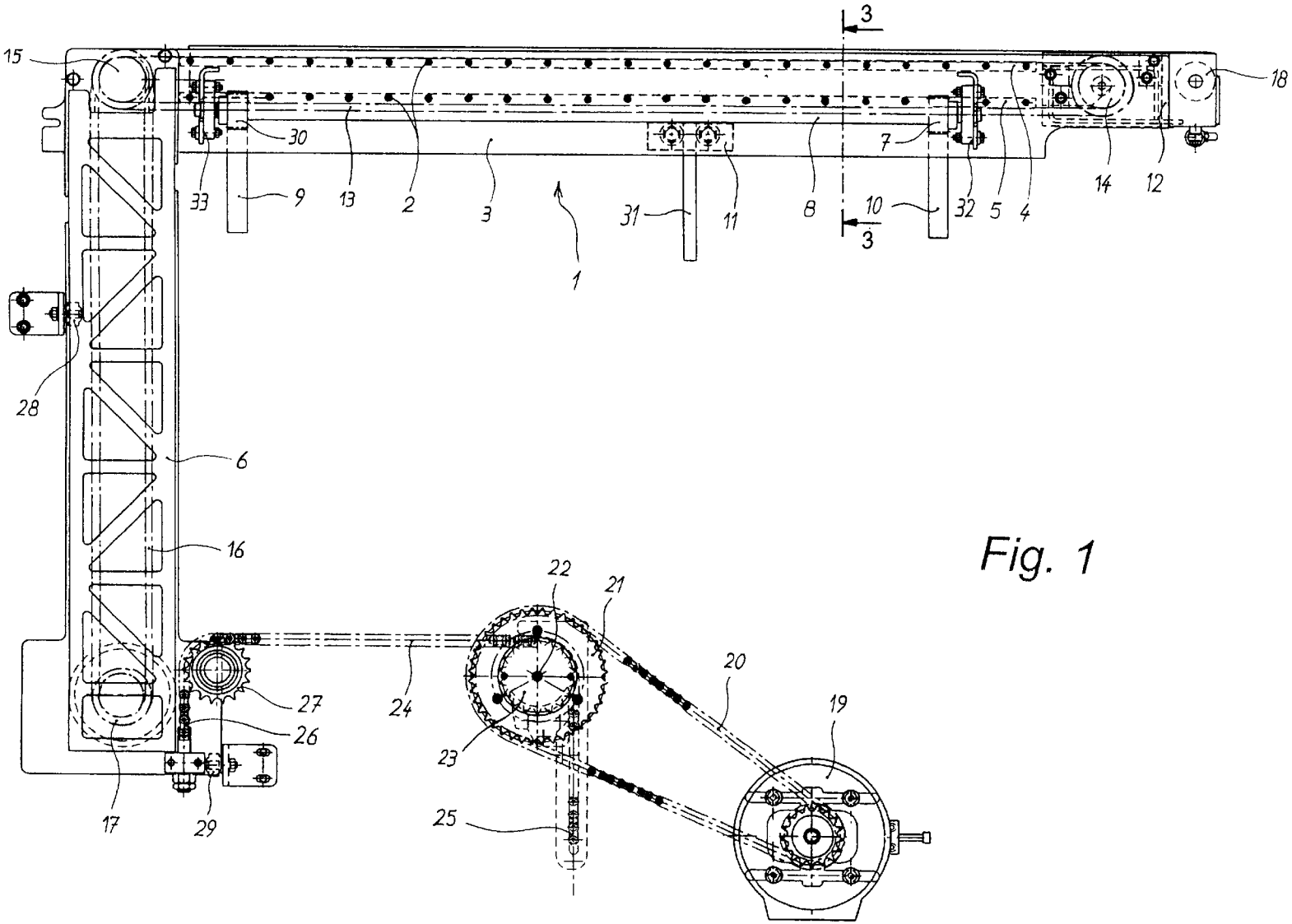
FIG. 1 is a side elevation view of a vertically movable transverse frame.

FIG. 1 shows, from a side elevation view, a crossing frame 1 and an associated elevating mechanism. The frame comprises two longitudinal horizontal beams 3, one of which is shown (the other being located behind the plane of FIG. 1). These two beams are located near the side walls, on the operators side (o.s.) and opposite the operator's side (o.o.s.) of the frame of the tress delivery station. The two longitudinal horizontal beams 3 are connected by one or more horizontal transverse beams. One transverse beam 12 is located near the blanking delivery area. A second central transverse beam 11 may also be provided. At the other end of the longitudinal horizontal beams 3 are located two vertical beams 6. The two pairs of beams 3 and 6 are in a "L" configuration on both sides, o.s and o.o.s. of the machine; the whole unit involving 6 beams 3, 6, 11, 12 is rigid.

Each one of the two longitudinal horizontal beams 3 holds on its vertical side pointed towards the machine axle a series of longitudinal horizontal rails 4 and 5 secured at their respective opposite ends on beams 3. Rails 4 and 5 carry and guide a movable carriage 40 (see FIG. 3).

The driving system for carriage 40 comprises a chain 13, whose two ends are attached to the movable carriage, forming thus a closed loop. The chain 13 is tightened between a reverse wheel 14, located near the beam 12 find a reverse pinion 15 rotatably attached to the upper end of beam 6. A second chain 16 rides on the reverse pinion 15 and forms a closed loop, stretched at the lower end of the vertical beam 6 around a driving pinion 17, which, in turn, is rotated by an motor (not shown) assembled and secured at this level onto the vertical beam. The whole unit made up of the motor, of the driving pinion 17, of the chain 16, of the reverse pinion 15 of the chain 13 and of the reverse wheel 14 allows the moving of the non-stop delivery rack between a resting position where the carriage is moved back near to the vertical beams 6 and an extended position, where the movable carriage is near to the transverse beam 12. The two longitudinal horizontal beams 3 also carry, at a position upstream from the cross beam 12, a roller 18 on which is laying and rolling the free end of the bars forming the non-stop delivery rack.

The vertical movement of the crossing frame 1 is effected by means of an motor 19 which cooperates with the delivery station frame of the press. The rotation of the motor 19 drives, through a chain 20 and a toothed pinion 21, the rotation of an horizontal and transverse transmission shaft 22, located in the lower part of the press frame. The transmission shaft 22 holds at each one of its ends a toothed pinion 23, driving a chain 24, of which one end 25 is free and the other end 26, after travelling through a reverse pinion 27, is secured to the lower end of a vertical beams 6. The rotation of the motor 19, in one sense or in the other, elevates or lowers teams 6. The beams 6 are thus hanging onto chains 26. Beams 6 are maintained in place relative to the side walls of the delivery station frame by two rollers 28 and 29 secured on these walls by "L" shaped fastening parts.

The use of a single motor and of similar driving parts on the two sides of the machine ensure the maintenance ck the left/right (transverse) horizontality of frame 1 during its vertical movement.

The front/back horizontality of beards 3, of rails 4, 5 and, therefore of the movable carriage 40 and the delivery rack is ensured, on each side of frame 1, thanks to an horizontal and longitudinal torsion bar 8, which holds at its ends two pionions 7, 30, identical, coaxial and interdependent of the torsion bar. The axle of the pionions and of the bar is carried by axle supports 33, 32, interdependent of beam 3. Each one of the two pinions 7 and 30 is gearing with a respective vertical toothed rack 9, 10, interdependent of the press delivery station frame. A previous location setting of the toothed racks 9, 10 allows to correct a horizontality defect of the non-stop rack. The torsion bar 8, which is turning around while the crossing frame goes up or down, keeps the forth/back horizontality of the whole unit during this vertical moving of the frame.

Figure 2:
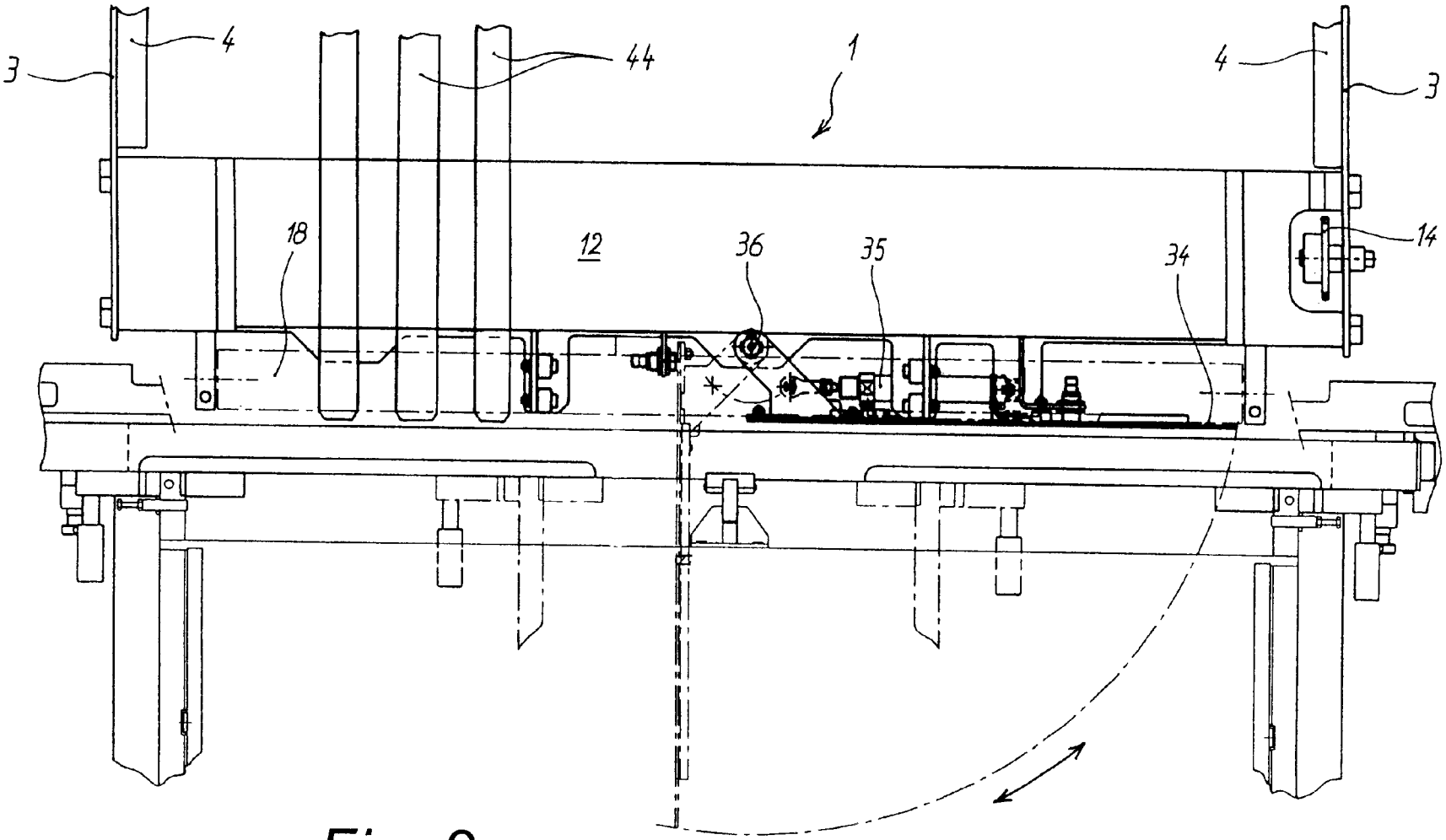
FIG. 2 is a top view (which must be rotated 90° counterclockwise for proper orientation relative to FIG. 1) including a device for detecting the position of the delivery rack relative to the station joggers.
Figure 3:
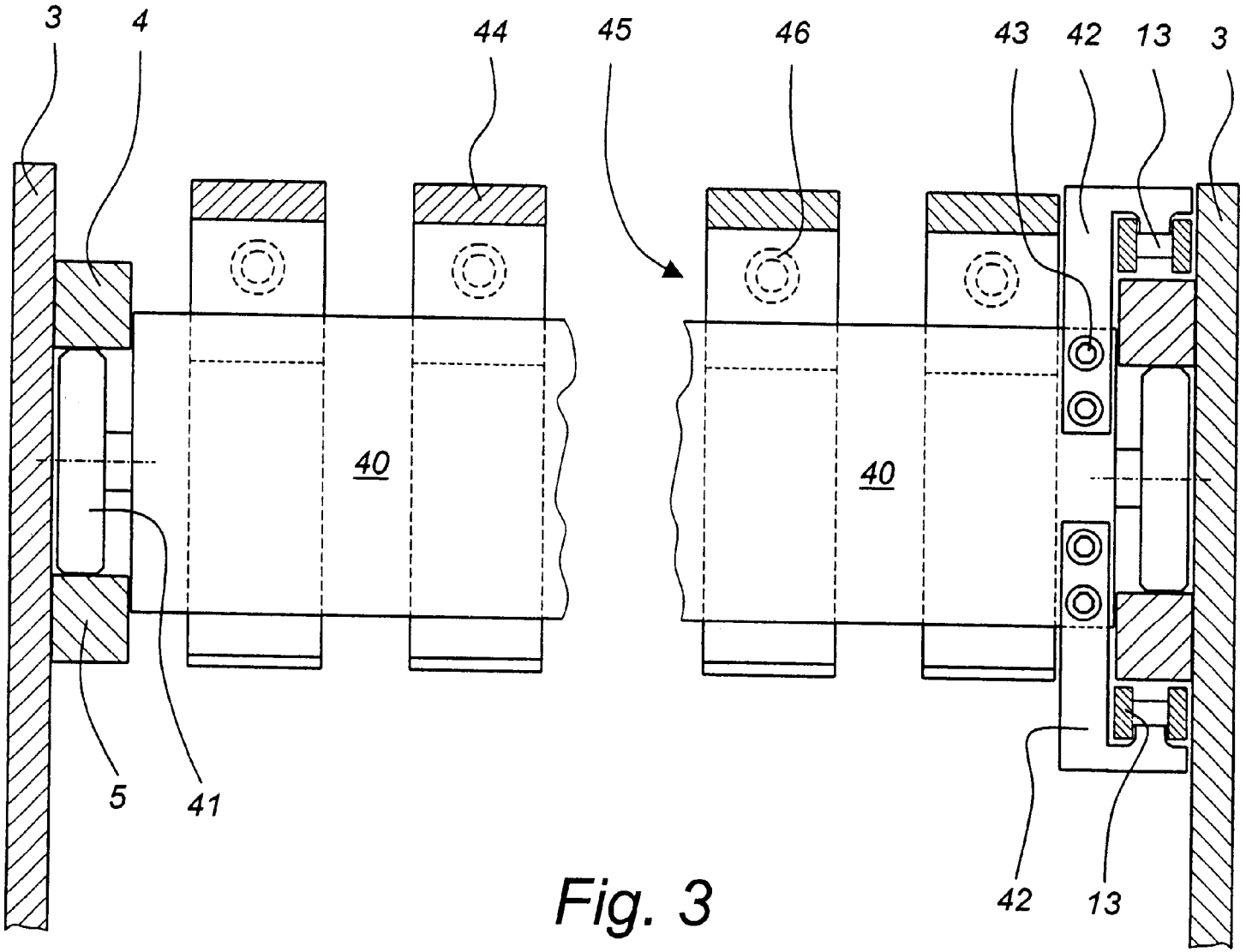
FIG. 3 is a partial sectional view of a conventional movable carriage as used according to the invention taken along line A—A in FIG. 1.

FIG. 3 shows the essential features (in a cross-sectional view taken along line 3-3 in FIG. 1) of the movable carriage assembly 40 for the non-stop delivery rack. Carnage 40 includes rollers 41 on each side. These travel in the paths defined by the upper and lower tracks 4 and 5 as carriage 40 moves in the upstream direction (to the right in FIG. 1 and down in FIG. 2) from its rest position illustrated in FIG. 2 and back under control of chain 13. The movement of chain 13 is transmitted to carriage 40 by a securing system 42 maintained at one of its ends on the movable carriage by screws 43, and engaged at its other end 42a between two links of the chain.

A plurality of bars 44 receive the blanks during the insertion operation. Each of bars 44 are secured at their respective downstream ends on a coupling flange 45 secured to carriage 40 by a screw 46. As illustrated in FIG. 2, the upstream ends of bars 44 rest on roller 18.

Referring again to FIG. 1 to limit the vertical run of the crossing frame, the walls of the press frame each carry a fixed block 31, located below the torsion bar 8 and against which this bar 8 should come and ridge in an extremely low position. The two blocks 31 are only a security device, because under usual functioning, the crossing frame does not reach this extremely low position. The lowest position effectively reached during an ensuring period is determined by the length of the lower blank tool joggers. Indeed, the top of the delivery rack should not go down below the height of the lower end of the joggers because if not, during the backwards run of the bars, the piles would not be correctly laid onto the ensuring sheet.

FIG. 2 shows a scanning device of this position. On the right side of the figure, the location of the lower blanking tool is schematically represented.

FIG. 2 shows the vertically movable end of crossing frame 1, located near the delivery area. One can see from a top view, the end of the horizontal longitudinal beams 3, the transverse beam 12 and, in dotted lines, the roller 18. One can also see on the top of FIG. 2 the reverse wheel 14.

The beam 12 holds on its front (i.e. upstream) side, a feeler arm 34 pivotally mounted on a vertical axle 36. The rotation is controlled by a pneumatic cylinder 35 jointed at one end to beam 12 and at its other end to arm 34, near to the rotation axle 36. As a result, the arm 34 can rotate in a horizontal plane. The rotation of arm 34 can be executed only if it is not obstructed by the lower end of a jogger. The pressure of a jogger in the path of arm 34 is detected by a sensor, for example, a contact sensor.

While the invention has been described in the contect of a specific embodiment, variations will be apparent for one skilled in the art. Accordingly, the scope of the invention is intended to be measured by the appended claims, and not by the above description.

What is claimed is:

1. A delivery station of a converting press for paper or cardboard sheets including:

a roller positioned transversely of a travel path of processed product from a blanking station;

a movable carriage located downstream from the roller, the carriage being operative to support a plurality of bars that form a non-stop blanking delivery rack;

a transporting device for moving the carriage in a longitudinal direction;

a vertically movable frame that carries the transverse roller, the carriage, the delivery rack and the carriage transporting device, the vertically movable frame being comprised of a first and a second vertical beam, each located on opposite sides of the travel path; and a drive mechanism for the vertically movable frame, the drive mechanism being comprised of:

a first and a second power transmission mechanism respectively associated with each vertical beam for imparting vertical motion thereto; and a single power source coupled to the first and second power transmission mechanisms.

2. A delivery station according to claim 1 wherein the range of motion of the drive mechanism is determined according to processing requirements for the paper or cardboard sheets.

3. A delivery station according to claim 1, wherein the vertical motion imparted by the drive mechanism is controlled by a feeler arm that senses the space located below the free ends of the bars forming the delivery rack.

4. A delivery station according to claim 1, wherein the carriage transporting device and the transverse roller are mounted on the vertically movable frame.

5. A delivery station according to claim 1, wherein the vertically movable frame extends transversely of the travel path, and includes a compensating mechanism that corrects and maintains the horizontality of an upper side of the bars forming the non-stop delivery rack.

6. A delivery station according to claim 1, further including a compensating mechanism that corrects and maintains the horizontality of an upper side of the cars forming the non-stop delivery rack.

7. A delivery station according to claim 6, wherein the compensating mechanism includes a torsion bar.

8. A delivery station according to claim 1, wherein the vertical run of the delivery rack is adjustable between a high position and a low position, the low position being determined by the length ofjoggers of a lower blanking tool of an upstream blanking station.

9. A delivery station according to claim 8, the vertically movable frame carries a sensor device that horizontally scans the space located below the free ends of the bars forming the delivery rack, and provides an indication when the frame of the delivery rack reaches a vertical position corresponding to the lower end of the joggers.

* * * * *